US007803428B1

(12) United States Patent
Archer, Jr. et al.

(10) Patent No.: US 7,803,428 B1
(45) Date of Patent: Sep. 28, 2010

(54) METHOD FOR DEPOSITION OF STEEL PROTECTIVE COATING

(75) Inventors: Harry L. Archer, Jr., Alexandria, VA (US); Wayne J. Powell, Palm Harbor, FL (US); Josephs T. Menke, Davenport, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 373 days.

(21) Appl. No.: 12/214,296

(22) Filed: May 28, 2008

Related U.S. Application Data

(62) Division of application No. 11/076,456, filed on Mar. 3, 2005, now Pat. No. 7,514,153.

(51) Int. Cl.
*B05D 3/00* (2006.01)

(52) U.S. Cl. ..... 427/328; 427/237; 427/331

(58) Field of Classification Search ..... 427/327, 427/328

See application file for complete search history.

(56) References Cited

U.S. PATENT DOCUMENTS

| | | | |
|---|---|---|---|
| 2,983,634 | A | 5/1961 | Budininkas |
| 3,088,846 | A | 5/1963 | Lee |
| 3,753,870 | A | 8/1973 | Hoffman et al. |
| 3,810,792 | A | 5/1974 | Ries et al. |
| 4,545,871 | A | 10/1985 | Krijl et al. |
| 4,793,867 | A | 12/1988 | Charles et al. |
| 5,393,353 | A | 2/1995 | Bishop |
| 5,766,374 | A | 6/1998 | Guillot et al. |
| 5,904,786 | A | 5/1999 | Wendel et al. |
| 6,527,841 | B2 | 3/2003 | Matzdorf et al. |
| 6,663,700 | B1 | 12/2003 | Matzdorf et al. |
| 2004/0163740 | A1 | 8/2004 | Keener et al. |

FOREIGN PATENT DOCUMENTS

| | | |
|---|---|---|
| JP | 11106940 | 9/1997 |
| JP | 11106941 | 9/1997 |
| JP | 11106984 | 9/1997 |

*Primary Examiner*—David Turocy
(74) *Attorney, Agent, or Firm*—Fredric J. Zimmerman

(57) ABSTRACT

A method is provided for coating a steel surface of a workpiece. According to an aspect of the invention, a steel workpiece is subjected to a first embrittlement-relief baking operation to form a protective oxide layer on the steel surface. The protective oxide layer is de-scaled, and the steel surface is activated. A hydrogen bather coating is deposited on the activated steel surface, and activated. A zinc-nickel alloy is plated on the barrier coating, and subjected to a second embrittlement-relief baking operation. The porous plating is sealed with a conversion coat. The method is especially useful in making low to no hydrogen embrittlement cadmium-replacement steel parts. Also provided is a corrosion resistant coated steel workpiece.

11 Claims, 5 Drawing Sheets

METHOD FOR DEPOSITION OF STEEL PROTECTIVE COATING

The present Application is a Divisional Application of U.S. patent application Ser. No. 11/076,456 filed on Mar. 3, 2005 now U.S. Pat. No. 7,514,153.

GOVERNMENT LICENSING CLAUSE

The invention described herein may be manufactured and used by or for the Government of the United States of America for governmental purposes without the payment of any royalties thereon or therefore.

BACKGROUND OF THE INVENTION

1. Field of the Invention

The present invention relates to methods for corrosion protection of steel workpieces, and more particularly to methods for depositing a cadmium-replacement or cadmium-alternative plating on steel workpieces.

2. Description of Related Art

Cadmium plating is used extensively for corrosion protection of steel workpieces, such as found in cartridge-activated devices and propellant-actuated (CAD/PAD) devices. Cadmium provides good corrosion protection, good lubricity, and may be applied as a thin coat so as not to conceal underlying surface formations and irregularities such as threads. However, the availability of cadmium for plating of steel is shrinking. Further, environmental protection regulations have restricted the use and handling of cadmium, which is considered to be toxic and a carcinogen.

Efforts have already been made to find a suitable cadmium replacement for coating steel parts. One potential replacement material is zinc-nickel alloy. Efforts to replace cadmium with zinc-nickel alloy have encountered certain problems. For example, conventional processes for plating zinc-nickel alloys have embrittled the steel substrate, causing premature failure of the steel. Zinc-Nickel plating has also been found to undergo dezincification corrosion.

SUMMARY OF THE INVENTION

It is therefore an object of the present invention to provide a cadmium-replacement plating method that uses materials having low toxicity and provides corrosion protection substantially equal or superior to that of cadmium.

Another object of the invention is to provide a steel treatment method for protecting the surface of a steel workpiece without causing significant hydrogen embrittlement to the workpiece.

It is another object of the invention to provide a steel treatment method for protecting the surface of a steel workpiece, wherein the protected surface possesses a coating that is suitable for painting.

In accordance with the purposes of the invention as embodied and broadly described herein, and to achieve one or more of the above-described objects, a first aspect of the invention provides a method for coating a steel surface of a workpiece. The method includes subjecting a workpiece including a steel surface to a first embrittlement-relief baking operation to form a protective oxide layer on the steel surface, de-scaling the protective oxide layer from the steel surface, activating the steel surface, depositing a hydrogen barrier coating on the activated steel surface to a thickness not greater than about 2.54 microns (0.1 mil), activating the hydrogen barrier coating, plating a zinc-nickel alloy layer on the activated hydrogen barrier coating to form a zinc-nickel porous plate, subjecting zinc-nickel porous plate to a second embrittlement-relief baking operation in a substantially inert atmosphere, and sealing the zinc-nickel porous plate with a conversion coat. The alloy layer includes about 85 weight percent to about 95 weight percent zinc and about 5 weight percent to about 15 weight percent nickel.

In accordance with the purposes of the invention as embodied and broadly described herein, a second aspect of the invention provides a method for coating a steel surface of a workpiece. According to this embodied method, a workpiece is subjected to a first embrittlement-relief baking operation to form a protective oxide layer on a steel surface of the workpiece. The protective oxide layer is de-scaled from the steel surface, and the de-scaled surface is subjected to a first rinsing operation without water-break in accordance with ASTM F22. The surface is activated, subjected to a second rinsing operation without water-break in accordance with ASTM F22, and receives a hydrogen barrier coating having a thickness not greater than about 2.54 microns (0.1 mil). After a third rinsing operation without water-break in accordance with ASTM F22, the hydrogen bather coating is activated and subjected to a fourth rinsing operation without water-break in accordance with ASTM F22. A zinc-nickel alloy layer including about 85 weight percent to about 91 weight percent zinc and about 9 weight percent to about 15 weight percent nickel is plated on the activated hydrogen bather coating to form a porous plate. The zinc-nickel porous plate is subjected to a fifth rinsing operation, and a second embrittlement-relief baking operation in a substantially inert atmosphere. The zinc-nickel porous plate is sealed with a non-hexavalent chromate conversion coat.

According to a third aspect of the invention, a method for coating a steel surface of a workpiece is provided. According to this embodied method, a workpiece is subjected to a first embrittlement-relief baking operation to form a protective oxide layer on a steel surface of the workpiece. The protective oxide layer is de-scaled from the steel surface, and the de-scaled surface is subjected to a first rinsing operation without water-break in accordance with ASTM F22. The surface is activated, subjected to a second rinsing operation without water-break in accordance with ASTM F22, and receives a hydrogen barrier coating having a thickness not greater than about 2.54 microns (0.1 mil). After a third rinsing operation without water-break in accordance with ASTM F22, the hydrogen bather coating is activated and subjected to a fourth rinsing operation without water-break in accordance with ASTM F22. A zinc-nickel alloy layer is plated on the activated hydrogen barrier coating to form a porous plate, the alloy layer including about 93 weight percent to about 95 weight percent zinc and about 5 weight percent to about 7 weight percent nickel. The zinc-nickel porous plate is subjected to a fifth rinsing operation, and a second embrittlement-relief baking operation in a substantially inert atmosphere. The zinc-nickel porous plate is sealed with a non-hexavalent-chromate conversion coat, for example, trivalent chromate, and prepared for priming and/or painting.

A fourth aspect of the invention provides a coated steel article, including a work piece having a steel surface, a hydrogen bather coating having a thickness not greater than about 2.54 microns on the steel surface, a porous zinc-nickel alloy layer on the activated hydrogen bather coating, the alloy layer comprising about 85 weight percent to about 95 weight percent zinc and about 5 weight percent to about 15 weight percent nickel, and a conversion coat sealing the porous nickel-zinc alloy layer.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF EMBODIMENTS AND METHODS OF THE INVENTION

Figure 1:
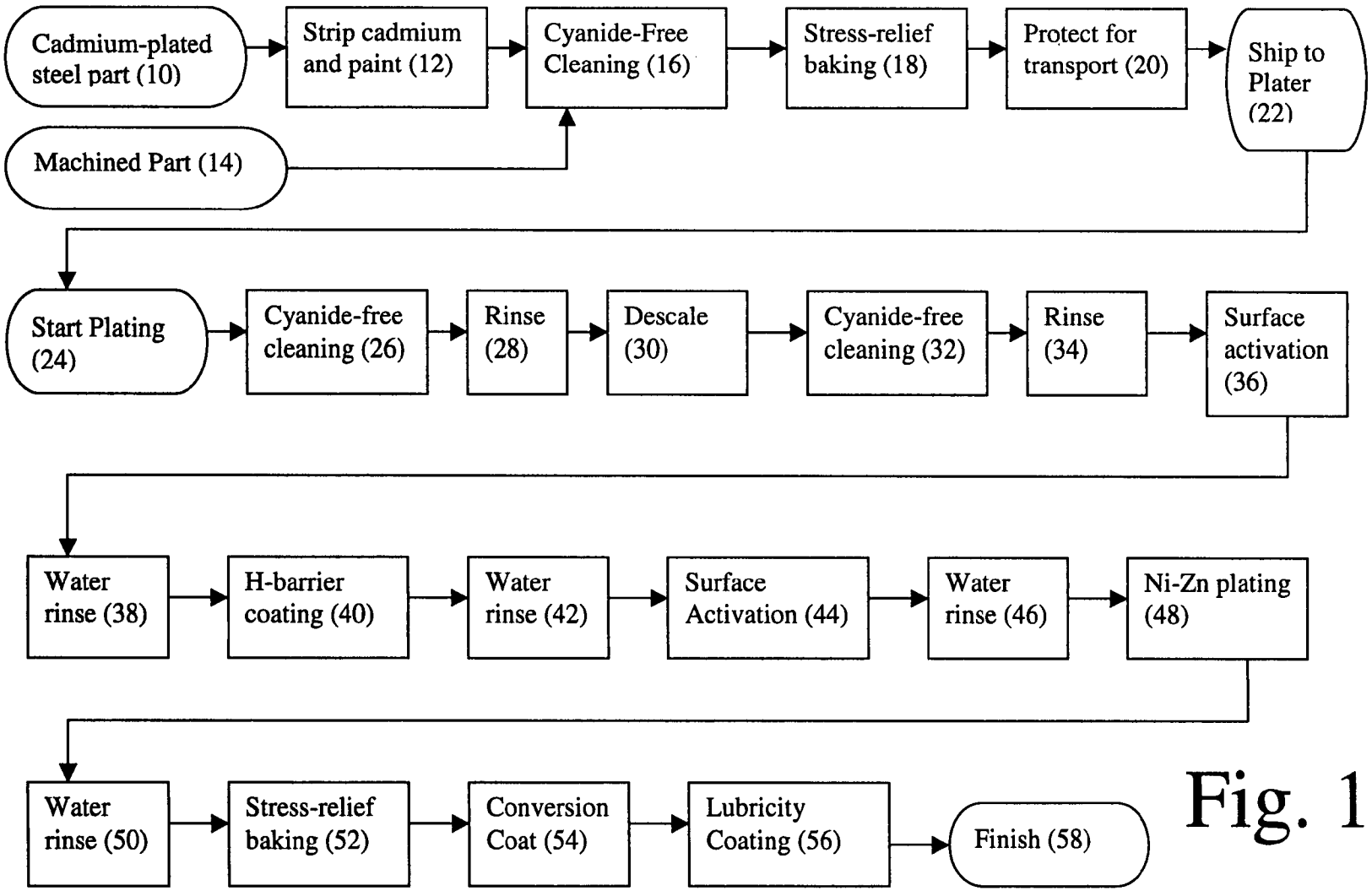
FIG. 1 is a flowchart of a method for plating a steel workpiece according to an embodiment of the invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise. For example, reference is made throughout the disclosure and claims to treatment steps of a workpiece "surface". It is to be understood that the steps may include, and typically will include treatment of multiple or all exposed surfaces of the workpiece.

Turning to FIG. 1, the embodied method illustrated in flowchart format therein is typically yet optionally applicable for nickel-zinc plating workpieces that are not intended for subsequent painting. Workpieces that may be subjected to embodiments of the invention include cadmium-plated steel parts 10 and original machine parts 14. As referred to herein, workpieces include, for example, finished articles, unfinished articles, substrates, components, sub-components, products, etc. A workpiece may be made entirely of steel, or may include materials other than steel but possessing one or more exposed steel surfaces. Workpieces 10, 14 include those found in such devices as, for example, military munitions (e.g., propellant actuating devices), springs, automobile parts, parts requiring lubricity or used in outside environments, door-lock parts, hardware, etc. Cadmium-plated steel parts 10 (or steel parts having other plating) are typically subjected to a stripping operation 12 to remove the cadmium plating layer and any paint. In the event that machined parts 14 have been plated or painted, machine parts 14 may be subjected to a stripping operation, if necessary. The stripping operation is, for example, cyanide free, such as carbon-dioxide blasters. The stripping operation may include, for example, chemical and/or mechanical treatment.

Stripped steel part 10 or machined part 14 is then subject to cleaning step 16, for example, with a cyanide-free cleaner. The cleaning step 16 is performed, for example, by immersing the workpiece into the cleaning solution, although spray and foam cleaning operations is possible. For example, alkaline solutions are useful for removing solvent residues and soil contaminants. Alkaline cleaners are commercially available. Exemplary alkaline solutions are ISO PREP 172 available from MacDermid, Inc. and Zep Formula 9878 of Zep Manufacturing Company. It should be understood that other alkaline and non-alkaline cleaners, such as citrus cleaners, and other cleaning techniques may be practiced.

The cleaned workpiece is subjected to a first stress-relief baking operation 18 in accordance with the procedures of ASTM B849-94 to reduce the susceptibility of the workpiece to hydrogen embrittlement or degradation. Stress-relief baking operation 18 is typically performed within three (3) hours of the optional stripping step 12, and produces an oxide layer (iron oxide) that optionally will have a scale-like appearance, depending upon the temperature selected for baking 18. Stress-relief baking 18 generally includes baking at a temperature high enough to drive off hydrogen from the surface and to form an oxide layer. If left untreated, hydrogen in the workpiece can cause a loss of ductility, load-carrying ability, or cracking of the workpiece, as well as catastrophic brittle failures of the workpiece at applied stresses below the yield strength of the alloy. Baking 18 may be performed in a convection oven, although non-convection ovens may be used. The temperature selected for baking operation 18 is generally performed in a predetermined range of about 130° C. to about 230° C. depending on the strength of the material. Reproduced below is a Table from ASTM B849-94 setting forth-exemplary heat treatment conditions.

| Class | Tensile Strength (MPa) | Temperature (° C.) | Time (minutes |
|---|---|---|---|
| SR-1 | Over 1800 | 200-230 | 24 |
| SR-2 | Over 1800 | 190-220 | 24 |
| SR-3 | 1401 to 1800 | 200-230 | 18 |
| SR-4 | 1450 to 1800 | 190-220 | 18 |
| SR-5 | 1034 or greater | 177-205 | 3 |
| SR-6 | 1000 to 1400 | 200-230 | 3 |
| SR-7 | 1050 to 1450 | 190-220 | 1 |
| SR-8 | Surface-hardened ≦ 1400 | 130-160 | 8 |

Items having tensile strengths below 1400 MPa and surface-hardened areas that would suffer an unacceptable reduction in hardness by treatment using the conditions set forth in the above Table shall be heat-treated at a lower temperature, but not below 130° C., for a period of 8 hours or longer. For tempered steels, work pieces, for example, are not typically heated above a temperature that is at least 50° C. below the tempering temperature.

After stress-relief baking operation 18, the workpiece having an oxide layer formed thereon is protected in step 20 for transport 22 to shipper. Stress-relief baking removes stress concentration sites that can cause premature stress-induced failure. Further, stress-relief baking also may bake out previously sorbed hydrogen. Another potential benefit of stress-relief baking is that the resulting oxide layer left by stress-relief baking tends to prevent hydrogen from resorbing into the steel. Protection step 20 generally includes procedures for preventing re-embrittlement and pitting corrosion. For example, protection step 20 may include application of a desiccant or VCI (vapor corrosion inhibitor) paper to preserve the steel surface of the workpiece. Transport 22 is typically conducted in a dry environment. It should be understood that protection and transport steps 20, 22 may not be necessary, such as, if preparation and plating of the workpiece are to be conducted at the same location.

The overall plating operation 24 is begun by removing the protection applied in step 20 and cleaning 26 the oxide layer of steel workpiece. Cleaning operation 26 is performed, for example, with a cyanide-free cleaner, and more particularly an alkaline solution. The cleaner used in operation 26 may be the same as or different than the cleaner used in cleaning step 16. For example, a citrus-based or alkaline-base cleaner may be selected. Cleaning 26 may include immersing the workpiece in a bath.

The cleaned workpiece is subjected to a rinsing operation 28 with water. Generally, this operation and other rinsing operations described herein are performed with distilled or demineralized water. Rinsing 28 is generally conducted in a water bath, which optionally may be stirred or otherwise agitated during rinsing. If the water is reused before disposal, it is typical yet optional that the rinsing operation 28 includes a double or triple counterflow rinse. Rinsing operation 28 and other rinsing operations used in this exemplary embodiment are conducted in compliance with the ASTM F22 water-break test, which covers the detection of the presence of hydrophobic (non-wetting) films on surfaces. Generally, the water-break test of ASTM F22 is performed by withdrawing the surface to be tested, in vertical position, from a container overflowing with water. The interpretation of the test is based upon the pattern of wetting. In the absence of hydrophobic films, the draining water layer will remain as a film over the surface. In areas where hydrophobic materials are present on the surface, the draining water layer will break up into a discontinuous film, translating into a failed test. It should be noted that ASTM F22 calls for the test to be conducted over a one-minute period, i.e., a discontinuous film should not appear within one minute for a passed test, and thus the film should be continuous. For the purposes of this invention, it is not necessary to wait one minute between the water bath 28 and the de-scaling operation 30 (discussed below). Instead, as referred to herein the phrase "without water-break in accordance with ASTM F22" means that a water-break is not observed during the time period of the actual test. Further, the surface is free enough of hydrophobic organic materials and other contaminants so that the surface would pass a water break test (i.e., a discontinuous film would not have been formed) had the test been carried out, for example, for one minute. In the event the water-break test of operation 28 is failed, the workpiece is returned to cleaning stage 26.

The cleaned workpiece is subjected to a de-scaling operation 30 to remove the majority of the oxide layer. The term "de-scaling" is derived from the removal of scale-like patterns often found on the workpiece. For the purpose of this invention, in the event that the workpiece lacks "scales", the term "de-scaling" shall be understood as to mean removal of the oxide layer. De-scaling operation 30 is optionally performed in compliance with MIL-S-5002, Amendment 2. According to an embodiment, de-scaling operation 30 includes abrasively cleaning the surface to remove heat-treated scale and oxidation as applicable, for example, without pickling. Typically, a non-metallic scrub pad (i.e., Scotch-Brite® pad Model 6448) is used to scrub any corrosion of the outside surface. Any alkaline cleaning is generally either anodic (reverse) current or no current. Rust Remover GDP1000, produced by Global Diversified Products, is a suitable scrubbing agent. Cyanide-based cleaners are not preferred. Scrubbing is typically continued until the oxide film is no longer visible.

The de-scaled workpiece is subjected to another cleaning operation 32. For example, the cleaning operation 32 is carried out in compliance with ASTM B322-99, and typically, does not release ODS (ozone-depleting substances) into the atmosphere. Cleaners identical to or different than those used in steps 16 and 26 may be selected. Exemplary cleaning agents are citric acid and ENSOLV, available from Enviro Tech, International, Inc. An acid bath may be used to neutralize alkaline residues or clean the substrate of contaminants that are different from the contaminants treated by the alkaline cleaners.

The workpiece is subjected to a rinsing operation 34. Rinsing procedures and the use of a water-break test standard may be applied as described above with regard to the rinsing operation 28. If the water-break test is not passed, the workpiece may be returned to the cleaning operation 32.

The surface of the workpiece is activated in step 36 to receive a hydrogen barrier layer. Activation 36 generally involves the removal of remnants, if any, of the oxide layer that were not removed or formed after de-scaling operation 30. An exemplary activating agent is hydrochloric acid (5-10 wt % HCl in distilled water). Other suitable activators are muric acid, Woods activator, etc. Activation step 36 includes immersion of the workpiece into the activating agent, e.g., HCl solution, for a brief period, typically not to exceed 5 seconds, and more particularly about 1 second to about 2 seconds. Longer activation treatments tend to result in undesirable embrittlement of the workpiece.

The activated surface is subjected to another rinsing operation 38 for removing the activating agent. Rinsing procedures and the use of a water-break test standard may be applied as described above with regard to rinsing operation 28. In the event that the workpiece does not pass or would not pass the water break test, the workpiece may be returned to cleaning stage 28, 32, or 34, depending upon the contaminant causing the water break.

A hydrogen-barrier coating 40 is applied to the activated surface. In an exemplary embodiment, Nickel-phosphorus is used as the hydrogen-barrier coating 40 (sometimes referred to as the "nickel coating"). The nickel coating 40 is generally a Type 5, category 1 classification under ASTM B733-97, meaning that the coating generally has a phosphorus content of 10 weight percent or higher, and is not subjected to post heat treatment. Coating thickness is selected to permit the egress of hydrogen from the workpiece surface, yet to retard or eliminate ingress of hydrogen. The coating thickness is generally less than or equal to about 2.54 microns (0.1 mil), and more particularly in a range of about 1.27 microns (0.05 mil) to about 2.54 microns (0.1 mil). The nickel-phosphorus coating 40 is generally produced from an aqueous solution through chemical reduction reaction. To obtain consistent coating properties, the bath generally is monitored periodically for pH, temperature, nickel and hypophosphite. Replenishment of the plating solution and agitation of the solution are preferred.

Another rinsing and water-break operation 42 is performed, in which the workpiece is typically rinsed, sufficiently, to pass water break test ASTM F22 (as described above in step 28). Generally, failure of the water-break test is likely attributable to excessive passivation of the nickel-phosphorus coating. To avoid excessive passivation, rinsing is performed after application of the nickel-phosphorus coating, and subsequent processing is performed with little or no delay.

The surface is subjected to an activation procedure 44 to receive the zinc-nickel plating. The activation procedure 44 is similar to that described above in step 36. In an exemplary embodiment, the activation solution includes about 40 vol % HCl aqueous solution, and activation is carried out for about 30 seconds to remove oxide, if any, formed on the nickel-phosphorus due to passivation. Another rinsing operation 46 is then conducted, preferably together with a water break test, in a manner similar to that described above in step 28. When the above activation solution includes about 10 vol % to about 30 vol % HCL aqueous solution, the etching generally occurs too far to activate, that is, remove oxide. If the activation solution exceeds about 40 vol % HCL aqueous solution, then too much activation solution is being used, and thus is wasteful.

Plating stage 48 generally may follow the specifications laid out in ASTM designation B841-94 for Class 1 deposits, although the coating may have as much as 15 weight percent nickel. The plating solution and resultant deposited plating generally include about 85 to about 91 weight percent (and, for example, more typically about 87 to about 91 weight percent) zinc, and about 9 to about 15 weight percent (and, for example, more typically about 9 to about 13 weight percent) nickel. Deviations above and below the above ranges reduce the life cycle of the galvanic protection. For example, nickel content above about 15 weight percent may cause a part to rust and zinc content above about 91 weight percent provides no additional part life expectancy while increasing material cost. Further, the coating generally is produced from an aqueous electroplating system that may be either an alkaline or acid formulation. Plating thickness may be, for example, about 7.62 microns (0.3 mil) to about 25.4 microns (1.0 mil), depending upon the corrosion resistance desired. The plating stage may be followed by a rinsing operation 50, in which rinsing optionally, yet not necessarily, meets the requirements of water break test ASTM F22.

The workpiece is then subjected to another stress-relief baking operation 52, which may be conducted as described above with regard to step 18, following ASTM B849-94. Baking 52 is generally conducted in an inert atmosphere, such as a vacuum furnace (e.g., at $1\times10^{-3}$ Torr) or an inert gas purged furnace, to minimize or eliminate oxidization. Baking operation 52 provides stress relief and embrittlement relief, optionally using procedures set forth in SAE AMS 2759/9A. The Baking operation 52, for example, is conducted within three hours of the plating stage 48, and, generally, is no greater than 26 hours in duration.

The nickel-zinc plating formed in plating stage 48 is covered with a conversion coating 54, which generally is classified under ASTM B841-99 as Type B or C, Grade 8. The conversion coat applied in operation 54, for example, is free of hexavalent chromate, and more particularly, yet optionally, includes trivalent chromate. Other suitable conversion coats also may be used. Suitable conversion coating processes and procedures are described in detail in U.S. Pat. Nos. 6,527,841 and 6,663,700, the disclosures of which are incorporated herein by reference. According to an embodiment, the plated workpiece is treated with an acidic aqueous solution having an optimized pH ranging from about 2.5 to about 5.5 including, per liter of solution, from about 0.01 to 22 grams of water soluble trivalent chromium compound (e.g., trivalent chromium sulfate basic), about 0.01 to 12 grams of an alkali metal hexafluorozirconate, about 0 to 12 grams of a fluoro-compound selected from alkali metal tetrafluoroborates, alkali metal hexafluorosilicates, and mixtures thereof, from about 0.001 to 10 grams of a divalent zinc compound (e.g., divalent zinc sulfate, zinc acetate), from about 0 to 10 grams of a water-soluble thickener, and from about 0 to 10 grams of a water-soluble surfactant.

In the event that lubricity of the coated workpiece is required or desirable, the workpiece surface or a workpiece surface region(s) may be coated in a lubricity coating operation 56. For example, it is often desirable to lubricate lockwires, lockwire grooves, threads, and other mating parts. Typical lubricating agents include, for example, polytetrafluoroethylene (PTFE) and molybdenum disulfide. An example of a commercially available PTFE is RO-59 bonded lubricant coating available from RO-59, Inc. of Stoughton, Mass. The coating operation 56 may include such techniques as painting or dipping of the lubricating agent onto the metal workpiece. In preparation of the lubricating step 56, the surface may be degreased, chemically cleaned or lightly abrasive blasted, cleaned to remove abrasive particles, and air-dried. In the case of anodized aluminum or magnesium surfaces, degreasing and drying should suffice. The coating operation 56 may be divided into application of a primer and finish coating. The primer resin coat is applied in a thickness of, for example, 5 microns (0.2 mil) to 18 microns (0.7 mils), followed by a fusing step at 65 to 95° C. for 5 to 10 minutes. The finish resin coating material is applied in a thickness of, for example, 25 microns (1.0 mil) to 152 microns (6 mil), followed by fusing at 300 to 330° C. Accordingly, heat output is minimized while a thin film of lubrication is produced, which is fairly inert and compatible with the underlying surface.

Figure 2:
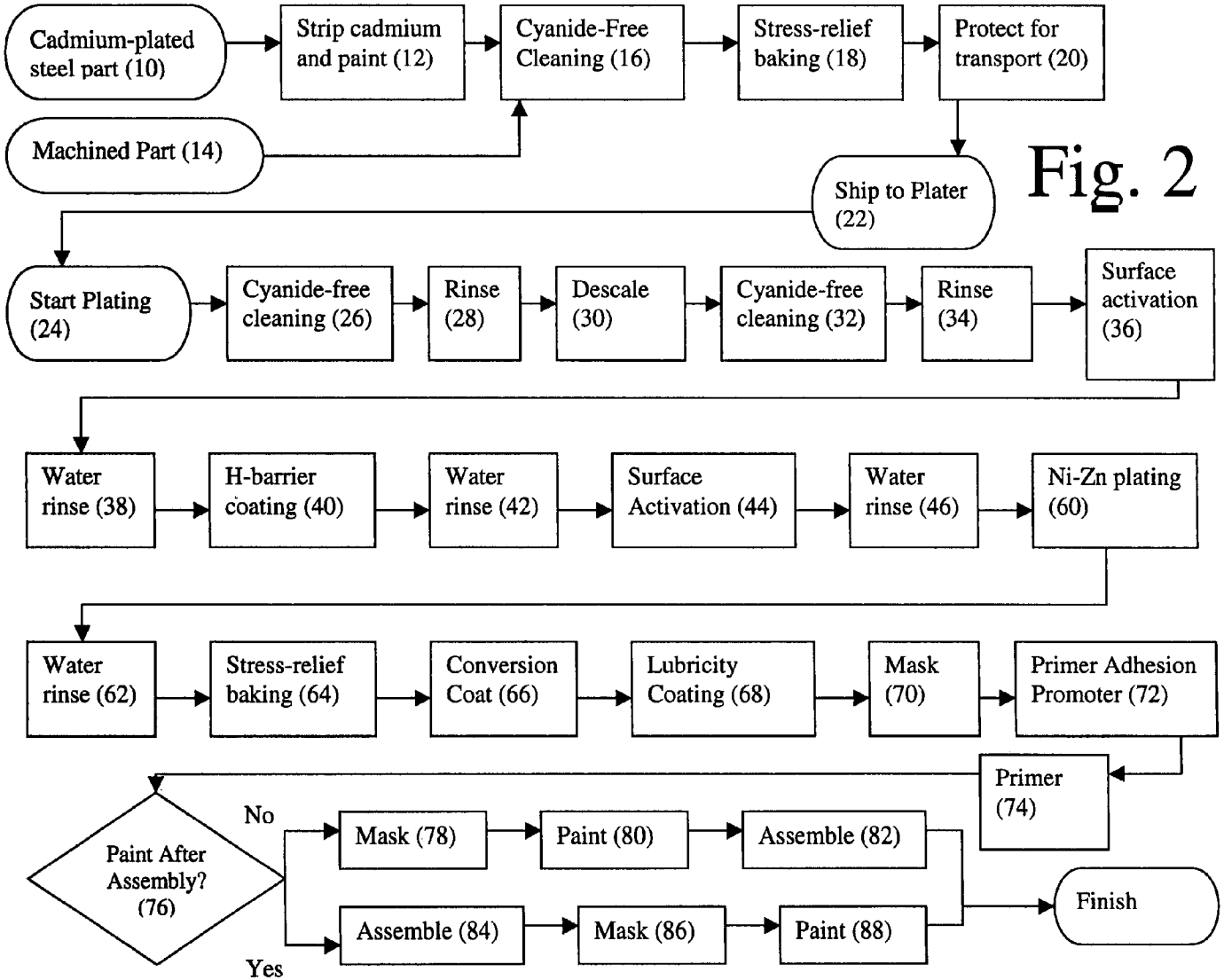
FIG. 2 is a flowchart of a method for plating a steel workpiece according to another embodiment of the invention.

Another embodiment of the invention is illustrated in flowchart format in FIG. 2. The embodiment shown in FIG. 2 is generally, yet optionally, applicable for nickel-zinc plating workpieces that are intended for subsequent painting. Steps and operations represented in FIG. 2 by reference numerals 10 through 46 are substantially identical to those described above in FIG. 1, and therefore their description is not reproduced hereinbelow in the interest of brevity.

Plating stage 60 generally may follow the specifications laid out in ASTM designation B841-94 for Class 1 deposits, and described above in regards to step 48, with the following exceptions. The plating solution and resultant deposited plating, which is a zinc-nickel alloy layer, includes, for example, about 93 to about 95 weight percent zinc, and about 5 to about 7 weight percent nickel. Accordingly, the high zinc content and low nickel content reduces metal toxicity while providing long-term, for example, 15 years, corrosion protection, particularly, in a marine environment. The plating stage 60 is generally followed by a rinsing operation 62, in which rinsing, optionally, yet not necessarily, meets the requirements of water break test ASTM F22.

The workpiece is then subjected to another stress-relief baking operation 64, which may be conducted as described above with regard to step 18, following ASTM B849-94. Baking 64 is generally conducted in an inert atmosphere, such as a vacuum furnace (e.g., at $1\times10^{-3}$ Torr) or an inert gas purged furnace, to minimize or eliminate oxidization. Baking 64 should provide embrittlement relief, as per SAE AMS 2759/9A.

Baking operation 64 generally is, for example, conducted within three hours of the plating stage 60, and typically is no greater than 26 hours in duration.

In a conversion coating step 66, nickel-zinc plating formed in plating stage 60 is covered with a conversion coating. In an exemplary embodiment, the conversion coat applied in operation 66 is substantially free of hexavalent chromate but may include trivalent chromate, and more particularly, yet optionally, includes a phosphate salt, such as zinc phosphate. Conversion coating step 66 optionally may follow the specifications of ASTM D2092 or TT-C-490E, which are incorporated herein by reference. According to the latter, the workpiece is subjected to a balanced aqueous solution containing phosphoric acid, zinc, and optionally accelerating agents until a uniform, insoluble phosphate coating is produced. Deposition of the conversion coat may include spray application, immersion, or dip application. The coating step 66 optionally may be followed by a rinsing step in order to remove residual salts and unreacted phosphating material, if appropriate. The conversion coat prevents zinc oxidation of the underlying zinc-nickel plating layer, as discussed above. Further, the conversion coat, which is intermediate the zinc-nickel plating layer and the paint layer, as indicated below, also acts as an adhesion promoter for the applied paint layer.

Painting and assembly procedures may vary depending upon the particular nature and needs of the workpiece. For example, in the event that lubrication of the workpiece is desirable, lubricating step 68 is conducted in the same manner as described above with respect to step 56 of FIG. 1. Optionally, one or more surface regions of the workpiece may be masked in step 70 using suitable masking tape, caps, or other means. A primer adhesion promoter (final rinse) may be applied to the workpiece, as illustrated by step 72. Suitable primer adhesion promoters include a 5 weight percent solution of EPDXYLIN of JohnsonDiversey, Inc. or low toxicity adhesion promoters that prevents primer/paint blistering in humidity. The use of an adhesion promoter is optional, and generally the need or desirability for the adhesion promoter may be circumvented if the primer is applied within a relatively short period (e.g., about 48 hours) after conversion coating deposition 66. Further delay will result in the formation of a zinc oxide film, which makes priming (in the absence of a primer adhesion promoter) difficult and unsatisfactory.

In primer application step 74, the unmasked conversion coat of the workpiece is coated with a primer, generally in a manner following military specification MIL-P-53030A(2). The composition may include, for example, a first component A (e.g., containing a bisphenol-A type epoxy resin, corrosion inhibitors, and pigments) and a second component B (e.g., containing clear resin solution). The pigment may include, for example, 50 wt % or more titanium dioxide, 10-20 wt % zinc phosphate, 0-30 wt % siliceous extenders, and 1.1-9 wt % corrosion inhibiting pigment (e.g., Sicorin RZ, of BASF Wyandotte Corp.).

If decision 76 is to paint the workpiece before assembly, then the workpiece is sequentially masked 78, painted 80, and assembled 82. If decision 76 is to paint after assembly, then the workpiece is sequentially assembled 84, masked 86, then painted 88. Masking 78, 86 may be performed as described above with reference to 70. Painting (topcoat) procedures may follow military specification PRF-85285.

Various advantages may be realized practicing embodiments of the invention. For example, it is optionally within the scope of the invention to practice the embodied methods without using cyanide-based chemicals. It is also optionally within the scope of the invention to practice the embodied methods without using hexavalent chromate. Further, the painting operation may be performed at room temperature, thus allowing heat-sensitive assemblies (e.g., ordnance, electronics, etc.) to be painted.

EXAMPLES

The invention will now be described with reference to the following examples, which are presented to elucidate the principals and advantages of aspects of the invention.

Figure 3:
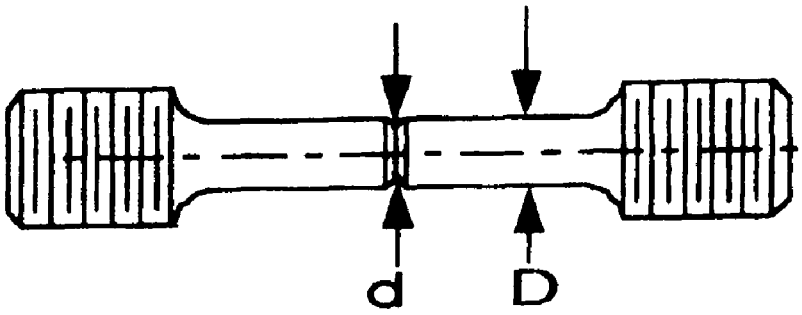
FIG. 3 is a schematic view of specimens subjected to mechanical hydrogen embrittlement evaluation.

ASTM Designation F519-97 was used as the standard test method for mechanical hydrogen embrittlement evaluation of the example plating processes. Under ASTM F519-97, the contents of which are incorporated herein by reference, acceptance requires that a plated notched specimen exceed 200 hours at a sustained load of 75% of the fracture stress or exceed a threshold of 57% of the fracture stress for a quantitative, accelerated (less than or equal to 24 hours) incrementally increasing or rising step load test. An example of a notched specimen is shown in FIG. 3. The specimen has threaded ends, an axial diameter D, and a notch diameter d.

Specimens A, B, C, and D (as shown in FIGS. 4-7) were each 4340 steel bars plated with 12% Ni-88% as described below:

Cleaning: Alkaline soak cleaned specimens to remove preservatives.

Rinsing: Double rinsed specimens in deionized water, optionally counterflow rinse.

Stress Relieve Bake: per ASTM B849-94, generally in vacuum or inert gas oven.

Descale: Cleaned specimens per MIL-S-5002, abrasively cleaned to remove heat treat scale and oxidation. Non-metallic scrub pad (Scotch-Brite® pad Model 6448 was used to scrub corrosion off the outer surface. Alkaline cleaning was either anodic (reverse)) current or no current. Cyanide-based cleaners were not used.

Rinse: Rinsed specimens in deionized water.

Activation: Steel surfaces were activated in 5-10% by weight hydrochloric acid/distilled water for 1-2 seconds.

Rinse: Rinsed specimens in deionized water.

Nickel Strike: A nickel-phosphorus coating of 0.05 to 0.1 mil was applied per ASTM B733-97 Type V, Class One on all surfaces of specimens.

Activation: The nickel strike was activated by submerging specimens in a solution of 40% by volume hydrochloric acid/distilled water for 30 seconds.

Rinse: Rinsed specimens in deionized water.

Plating: Plating was conducted per ASTM B841-99, Class One, Grade 5 on all surfaces of specimens.

Bake: Embrittlement relief was performed per SAE AMS 2759/9A within three hours after plating by baking the specimens. Maximum baking time was 26 hours. If a vacuum furnace is used, it should operate at about $1\times10^{-3}$ Torr.

Activation: The specimens were rinse dipped in the zinc-nickel plating tank with no applied current for about 2 seconds.

Rinse: Rinsed specimens in deionized water.

Conversion coat: A chromate corrosion coat was applied to the sample per ASTM B841-99, Type B or C, Grade 8.

Figure 4:
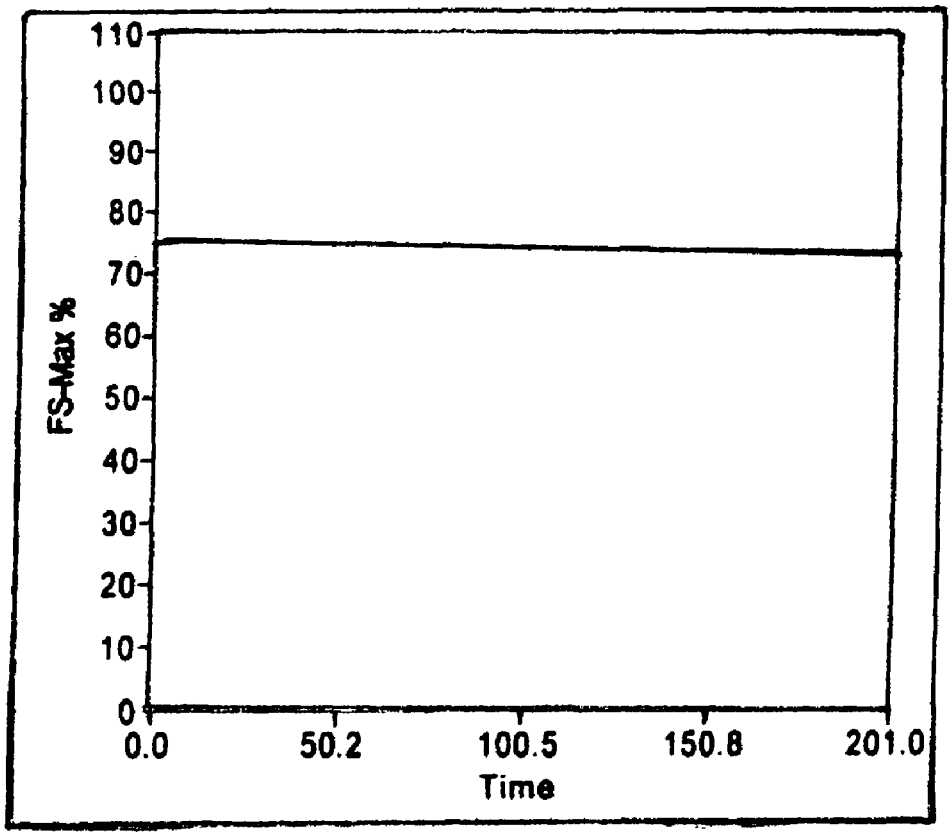
FIG. 4 is a graph of results for mechanical hydrogen embrittlement evaluation testing of specimen A.
Figure 5:
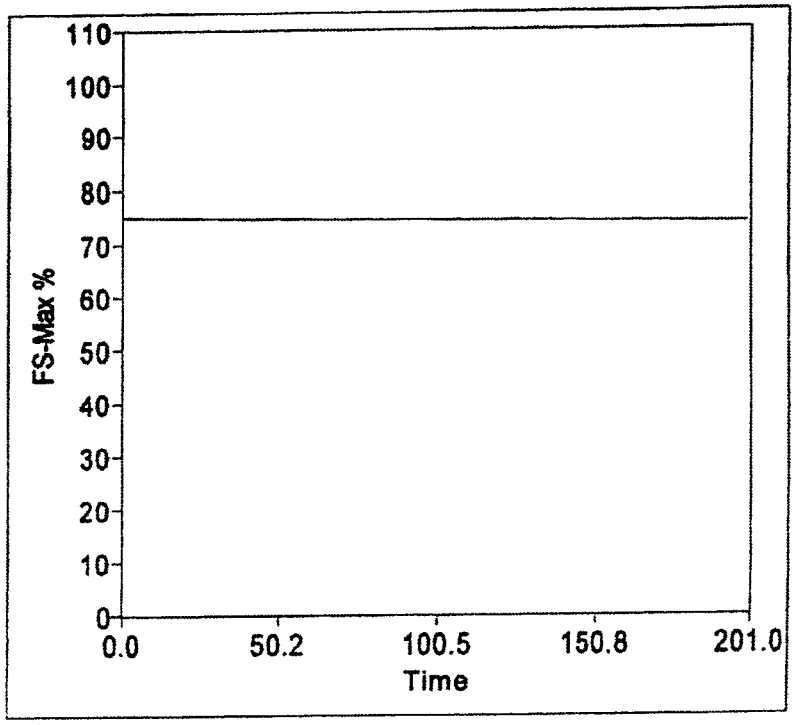
FIG. 5 is a graph of results for mechanical hydrogen embrittlement evaluation testing of specimen B.
Figure 6:
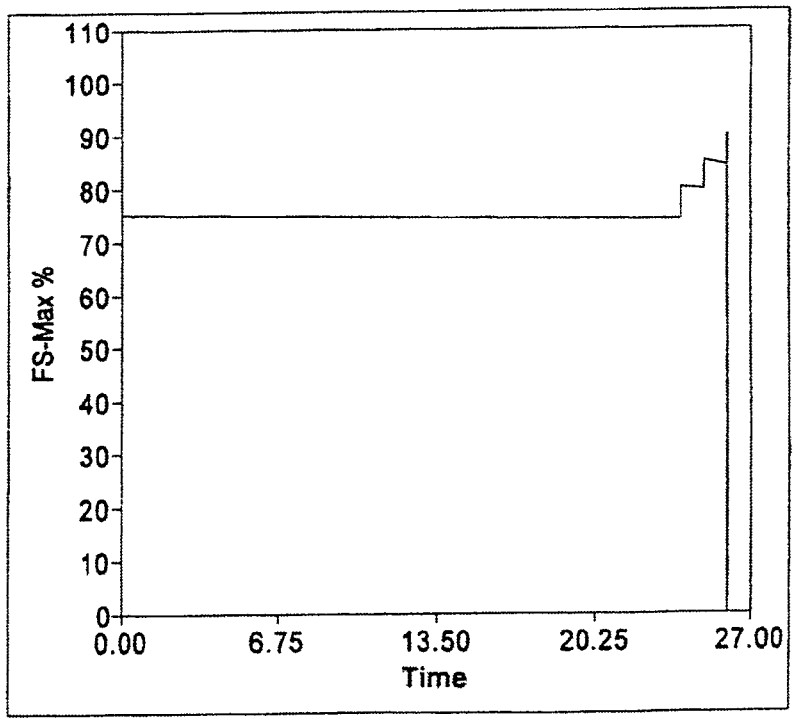
FIG. 6 is a graph of results for mechanical hydrogen embrittlement evaluation testing of specimen C.
Figure 7:
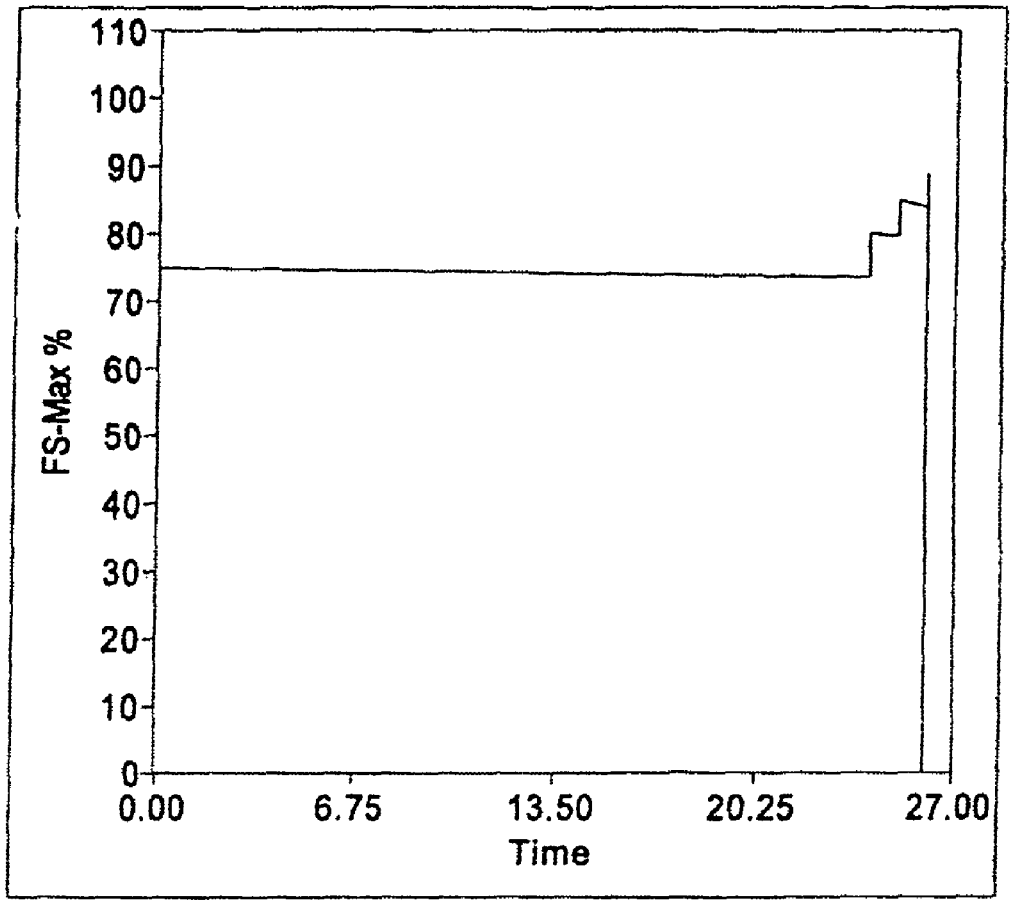
FIG. 7 is a graph of results for mechanical hydrogen embrittlement evaluation testing of specimen D.

The fracture load tension was calculated by multiplying tensile strength by net area ($Area_{net}$), where $Area_{net}=\pi d^2/4$. As shown in FIG. 4, specimen A having a fracture load tension of 9200 lbs was subject to a 75.1% threshold load of 6911 lbs for over 200 hours without failure. Specimen B shown in FIG. 5 was subject to a 75% threshold load of 6900 lbs for over 200 hours without failure. For specimen C, the threshold load was raised to 90%, i.e., about 8283 lbs. As shown in FIG. 6, even under this heightened threshold load specimen C last for more than 25 hours before failure. Similarly, specimen D subjected to a 89% load of 8190 lbs did not experience failure before 25 hours, as shown in FIG. 7.

The experiments demonstrate that specimens subjected to an embodied method showed sufficiently low hydrogen embrittlement to surpass the requirements of ASTM F519-97. These results are especially impressive given the relatively high 12% nickel in the plating.

Additional advantages and modifications will readily occur to those skilled in the art upon reference to this disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for coating a steel surface of a workpiece, comprising:

subjecting a workpiece comprising a steel surface to a first embrittlement-relief baking operation to form a protective oxide layer on the steel surface;

de-scaling the protective oxide layer from the steel surface;

activating the steel surface;

depositing a hydrogen barrier coating on the activated steel surface to a thickness not greater than about 2.54 microns;

activating the hydrogen barrier coating to form an activated hydrogen barrier coating;

plating a zinc-nickel alloy layer on the activated hydrogen barrier coating to form a porous plate, the zinc-nickel alloy layer comprising about 85 weight percent to about 95 weight percent zinc and about 5 weight percent to about 15 weight percent nickel;

subjecting zinc-nickel porous plate to a second embrittlement-relief baking operation in a substantially inert atmosphere; and sealing the zinc-nickel porous plate with zinc phosphate and trivalent chromate.

2. A method according to claim 1, wherein the hydrogen barrier coating comprises a nickel-phosphorus coating.

3. A method according to claim 1, wherein the thickness of the hydrogen barrier coating is in a predetermined range of about 1.27 microns to about 2.54 microns.

4. A method according to claim 3, wherein the zinc-nickel alloy layer comprises about 85 to about 91 weight percent zinc and about 9 to about 15 weight percent nickel, and wherein the conversion coat comprises trivalent chromate.

5. A method according to claim 3, wherein the zinc-nickel alloy layer comprises about 93 to about 95 weight percent zinc and about 5 to about 7 weight percent nickel, and wherein the conversion coat comprises zinc phosphate.

6. The method according to claim 1, wherein said first-embrittlement-relief baking operation is performed in a predetermined range of about 130° C. to about 230° C.

7. The method according to claim 1, wherein said zinc-nickel porous plate comprises a zinc-nickel alloy with a predetermined plating thickness in a range of about 7.62 microns to about 25.4 microns.

8. A method for coating a steel surface of a workpiece, comprising:

subjecting a workpiece comprising a steel surface to a first embrittlement-relief baking operation to form a protective oxide layer on the steel surface;

de-scaling the protective oxide layer from the steel surface;

subjecting the steel surface to a first rinsing operation without water-break in accordance with ASTM F22;

activating the steel surface;

subjecting the steel surface to a second rinsing operation without water-break in accordance with ASTM F22;

applying a hydrogen barrier coating to the activated steel surface to a thickness not greater than about 2.54 microns;

subjecting the hydrogen barrier coating to a third rinsing operation without water-break in accordance with ASTM F22;

activating the hydrogen barrier coating to form an activated hydrogen barrier coating;

subjecting the activated hydrogen barrier coating to a fourth rinsing operation without a water-break in accordance with ASTM F22;

plating a zinc-nickel alloy layer on the activated hydrogen barrier coating to form a zinc-nickel porous plate, the zinc-nickel alloy layer comprising about 93 weight percent to about 95 weight percent zinc and about 5 weight percent to about 7 weight percent nickel;

subjecting the zinc-nickel porous plate to a fifth rinsing operation;

subjecting zinc-nickel porous plate to a second embrittlement-relief baking operation in a substantially inert atmosphere;

sealing the zinc-nickel porous plate with zinc phosphate and trivalent chromate.

9. The method according to claim 8, further comprising stripping cadmium and paint from the steel surface prior to the first embrittlement relief baking operation.

10. The method according to claim 8, wherein the hydrogen barrier coating comprises a nickel-phosphorus coating.

11. The method according to claim 8, wherein the thickness of the hydrogen barrier layer is in a predetermined range of about 1.27 microns to about 2.54 microns.

* * * * *